US009352545B2

(12) United States Patent
Maejima et al.

(10) Patent No.: US 9,352,545 B2
(45) Date of Patent: May 31, 2016

(54) PRINTING/COATING METHOD AND APPARATUS

(75) Inventors: Kazuhiro Maejima, Ibaraki (JP); Isao Funabashi, Ibaraki (JP)

(73) Assignee: KOMORI CORPORATION, Tokyo (JP)

( * ) Notice: Subject to any disclaimer, the term of this patent is extended or adjusted under 35 U.S.C. 154(b) by 0 days.

(21) Appl. No.: 13/018,193

(22) Filed: Jan. 31, 2011

(65) Prior Publication Data

US 2011/0185927 A1 Aug. 4, 2011

(30) Foreign Application Priority Data

Feb. 2, 2010 (JP) ..... 2010-021336
Feb. 2, 2010 (JP) ..... 2010-021339

(51) Int. Cl.

| | |
|---|---|
| ***B05C 9/08*** | (2006.01) |
| ***B41F 7/26*** | (2006.01) |
| ***B41F 23/04*** | (2006.01) |
| *B41M 7/00* | (2006.01) |

(52) U.S. Cl.

CPC ..... *B41F 7/26* (2013.01); *B41F 23/0409* (2013.01); *B41F 23/0443* (2013.01); *B41M 7/0045* (2013.01); *B41M 7/0081* (2013.01)

(58) Field of Classification Search

CPC .... B41F 7/26; B41F 23/0409; B41F 23/0443; B41M 7/0045; B41M 7/0081
USPC ..... 101/217, 488, 491; 118/46, 223, 620
See application file for complete search history.

(56) References Cited

U.S. PATENT DOCUMENTS

| | | | | |
|---|---|---|---|---|
| 5,884,557 | A * | 3/1999 | Furbass | 101/148 |
| 2001/0009701 | A1* | 7/2001 | Schmitt | 427/559 |
| 2004/0259975 | A1* | 12/2004 | Robillard | 523/160 |
| 2005/0190248 | A1 | 9/2005 | Konno et al. | |
| 2008/0074484 | A1* | 3/2008 | Sugahara | 347/102 |
| 2008/0282974 | A1* | 11/2008 | Takemata | 118/620 |
| 2009/0269510 | A1* | 10/2009 | Lieberman et al. | 427/555 |
| 2010/0012028 | A1* | 1/2010 | Jinbo et al. | 118/702 |
| 2010/0132573 | A1 | 6/2010 | Saito | |

FOREIGN PATENT DOCUMENTS

| | | | |
|---|---|---|---|
| CN | 101096137 | | 1/2008 |
| CN | 201195427 | | 2/2009 |
| CN | 101578179 | | 11/2009 |
| DE | 3526082 | A1 | 1/1987 |
| EP | 1 923 435 | A1 | 5/2008 |
| EP | 1 992 486 | A1 | 11/2008 |
| GB | 2 082 121 | A | 3/1982 |
| JP | S54-123305 | A | 9/1979 |
| JP | 57-036660 | | 2/1982 |
| JP | 60131244 | A | 7/1985 |
| JP | 61-158451 | | 7/1986 |

(Continued)

*Primary Examiner* — Leslie J Evanisko
*Assistant Examiner* — Marissa Ferguson Samreth
(74) *Attorney, Agent, or Firm* — Blakely Sokoloff Taylor & Zafman LLP

(57) ABSTRACT

A printing/coating method includes the steps of transferring highly reactive ink/varnish which cures with a low light energy onto a transfer object, and irradiating the transfer object, onto which the highly reactive ink/varnish is transferred, with light in the wavelength range, in which no ozone is generated, to cure the highly reactive ink/varnish on the transfer object. A printing/coating apparatus is also disclosed.

8 Claims, 8 Drawing Sheets

(56) References Cited

FOREIGN PATENT DOCUMENTS

| | | | |
|---|---|---|---|
| JP | 04-018406 | | 1/1992 |
| JP | 05-116489 | | 5/1993 |
| JP | 06-500737 | | 1/1994 |
| JP | 09-156070 | | 6/1997 |
| JP | 11228899 | | 8/1999 |
| JP | 2002316402 | A | 10/2002 |
| JP | 2003-127517 | A | 5/2003 |
| JP | 2004-188864 | | 7/2004 |
| JP | 2006-281711 | | 10/2006 |
| JP | 2006-335924 | A | 12/2006 |
| JP | 2008-100493 | A | 5/2008 |
| JP | 2008-307891 | A | 12/2008 |
| JP | 2009061776 | A | 3/2009 |
| JP | 2009149037 | | 7/2009 |
| JP | 2009-173712 | A | 8/2009 |
| JP | 2009-221441 | A | 10/2009 |
| JP | 2009-226890 | A | 10/2009 |
| JP | 2009-263603 | A | 11/2009 |
| WO | WO 93/02329 | | 2/1993 |
| WO | WO 2006-061981 | A1 | 6/2006 |
| WO | WO 2007-034714 | A1 | 3/2007 |
| WO | WO 2007/065274 | A1 | 6/2007 |

* cited by examiner

PRINTING/COATING METHOD AND APPARATUS

BACKGROUND OF THE INVENTION

The present invention relates to a printing/coating method and apparatus which cure ink or varnish, transferred onto a transfer object, using light emitted by a light source.

A printing/coating method which prints or coats a sheet serving as a transfer object using ultraviolet curing ink or varnish and irradiates the sheet with ultraviolet rays from a UV lamp to cure the ultraviolet curing ink/varnish has conventionally been proposed, as disclosed in Japanese Patent Laid-Open No. 54-123305.

Light curing ink which contains a photopolymerization initiator and starts to cure upon being irradiated with light such as ultraviolet rays has also been proposed, as disclosed in Japanese Patent Laid-Open No. 2009-221441.

On the other hand, in recent years, a printing/coating method which attains both energy saving and a low environmental load has been developed. According to this technique, ultraviolet curing ink/varnish is cured using a light-emitting diode (LED-UV) which emits light with UV wavelengths in place of a conventional UV lamp, as disclosed in Japanese Patent Laid-Open No. 2008-307891.

In the above-mentioned conventional printing/coating methods, because light emitted by LED-UV has an extremely narrow wavelength range (e.g., 370 nm to 380 nm), only ink/varnish which reacts to light in a narrow wavelength range can be used as the ink/varnish which cures with light from LED-UV.

SUMMARY OF THE INVENTION

It is an object of the present invention to provide a printing/coating method and apparatus which attain both energy saving and a low environmental load.

It is another object of the present invention to provide a printing/coating method and apparatus which offer a wide range of choices for ink/varnish.

In order to achieve the above-mentioned object, according to an aspect of the present invention, there is provided a printing/coating method comprising the steps of transferring highly reactive ink/varnish which cures with a low light energy onto a transfer object, and irradiating the transfer object, onto which the highly reactive ink/varnish is transferred, with light in a wavelength range, in which no ozone is generated, to cure the highly reactive ink/varnish on the transfer object.

According to another aspect of the present invention, there is provided a printing/coating apparatus including a transfer liquid supply device which supplies ink/varnish onto a plate cylinder, and a pair of rollers which are in contact with each other and are driven to rotate so as to produce a counter-slip therebetween, comprising a dampening device which supplies dampening water onto the plate cylinder via the pair of rollers, a transfer device which uses the ink/varnish supplied from the transfer liquid supply device and the dampening water supplied from the dampening device to transfer the ink/varnish onto a transfer object, and a light irradiation device which irradiates the transfer object transported from the transfer device with light in a wavelength range, in which no ozone is generated, to cure the ink/varnish on the transfer object.

DESCRIPTION OF THE PREFERRED EMBODIMENTS

The present invention will be described in detail below with reference to the accompanying drawings.

[First Embodiment]

Figure 1:
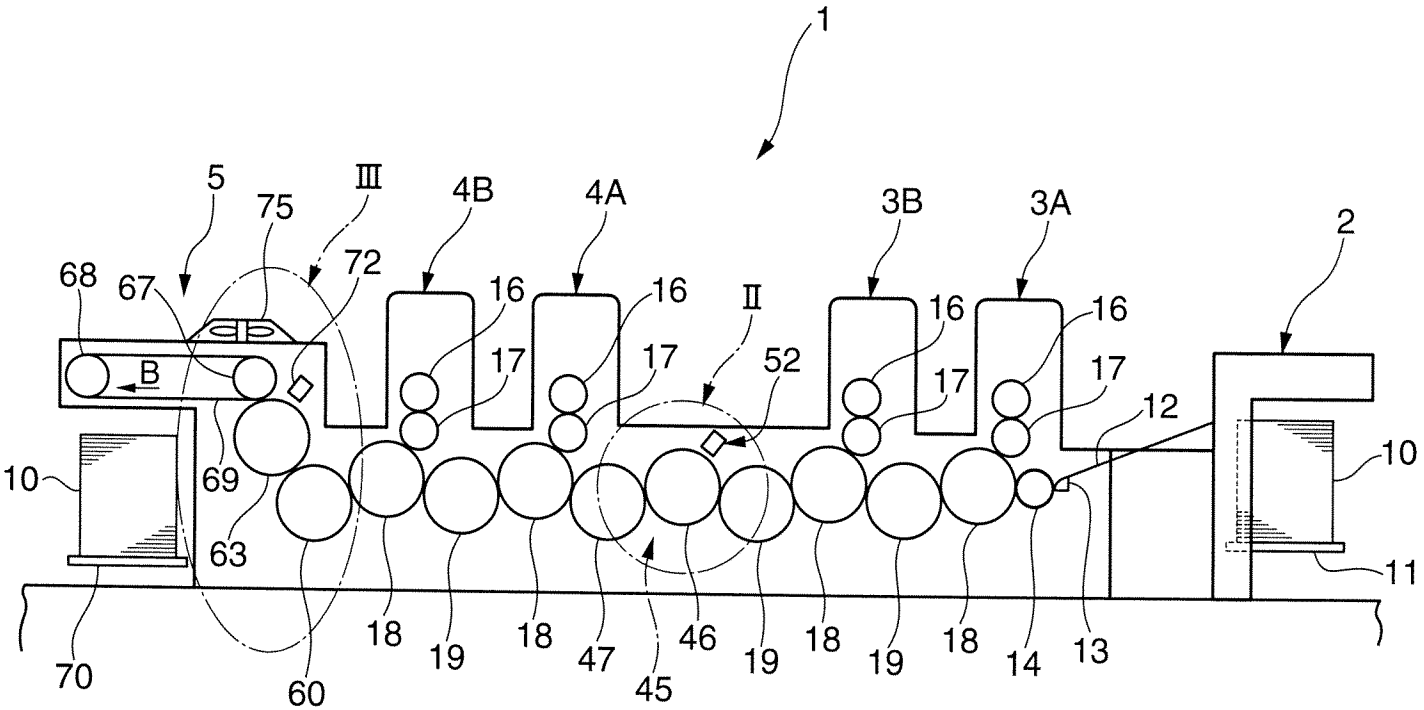
FIG. 1 is a side view showing the schematic arrangement of a sheet-fed offset rotary printing press to which a printing/coating method according to an embodiment of the present invention is applied.

As shown in FIG. 1, a sheet-fed offset rotary printing press 1 according to the first embodiment includes a sheet feeding device 2 serving as a device which supplies a transfer object, four printing units 3A, 3B, 4A, and 4B (liquid transfer units) which print on a sheet supplied from the sheet feeding device 2, and a sheet delivery device 5 which delivers the sheet printed by the printing unit 4B. The sheet feeding device 2 includes a pile board 11 on which a pile of paper sheets 10 (transfer objects) are stacked and which automatically ascends in proportion to a decrease in pile height of the paper sheets 10. A suction device (not shown) which sucks the paper sheets 10 one by one from its top one and feeds them to a feedboard 12 is disposed at a position above the stacked paper sheets 10.

Each of the printing units 3A, 3B, 4A, and 4B includes a plate cylinder 16 having a printing plate mounted on its peripheral surface, a blanket cylinder 17 onto which an image formed on the plate surface of the printing plate by ink (transfer liquid) and dampening water supplied from an inking device 20 (transfer liquid supply device) and a dampening device 35, respectively, is transferred, and a double-diameter impression cylinder 18 which holds and transports the paper sheet 10. While the paper sheet 10 passes through the gap between the impression cylinder 18 and the blanket cylinder 17, the image on the blanket cylinder 17 is transferred onto the paper sheet 10 by the printing pressure of the impression cylinder 18.

A swing arm shaft pregripper 13 is provided between the sheet feeding device 2 and the printing unit 3A. The swing arm shaft pregripper 13 grips the forward edge of the paper sheet 10 fed from the sheet feeding device 2 to the feedboard 12, and transfers it to grippers of a transfer cylinder 14 by a gripping change. Transfer cylinders 19 are provided between the impression cylinders 18 of the printing units 3A and 3B, between a suction cylinder 46 of a convertible press 45 (to be described later) and the impression cylinder 18 of the printing unit 3B, and between the impression cylinders 18 of the printing units 4A and 4B.

The inking device 20 and dampening device 35 provided in each of the printing units 3A, 3B, 4A, and 4B will be described next with reference to FIG. 5. The inking device 20 includes an ink supply device 21 and an ink roller group 22 which transfers ink supplied from the ink supply device 21. The ink supply device 21 includes an ink fountain roller 23 and an ink fountain 24 which stores highly reactive ink (highly reactive transfer liquid) 25 using the ink fountain roller 23 and a pair of ink dams.

The highly reactive ink means UV ink which cures with low light irradiation energies from light irradiation devices 52, 72, and 172 (to be described later), and is also called highly reactive UV ink, high-sensitivity ink, or high-sensitivity UV ink. The highly reactive ink is defined as UV ink which rapidly cures without requiring light having wavelengths which fall within the ozone generation range and generate a high light irradiation energy. The highly reactive ink 25 may be ink which reacts to light that has a single wavelength and is emitted by an LED or ink which reacts to light having wavelengths in a certain range as long as a wavelength to which it reacts falls in the wavelength range of light beams emitted by the light irradiation devices 52, 72, and 172.

The ink roller group 22 includes ink form rollers 27 in contact with the peripheral surface of the plate cylinder 16, oscillating rollers 28 in contact with the ink form rollers 27, three distribution rollers 29 which are provided at positions above the oscillating rollers 28 to be in contact with the oscillating rollers 28, an oscillating roller 33 in contact with one of the distribution rollers 29, two distribution rollers 30 and 32 which are provided at positions above the oscillating roller 33 to be in contact with the oscillating roller 33, and an ink ductor roller 31 which is provided between the ink fountain roller 23 and the distribution roller 30 and alternately comes into contact with the rollers 23 and 33.

The dampening device 35 includes a water fountain roller 38 immersed in dampening water 37 in a water pan 36, a metering roller 40 in contact with the water fountain roller 38, a ductor roller 41 in contact with the metering roller 40, and a water form roller 39 which is in contact with the ductor roller 41 and plate cylinder 16 and supplies the dampening water 37 to the plate cylinder 16. The water fountain roller 38 and water form roller 39 are driven to rotate in a direction (the counterclockwise direction in FIG. 5) opposite to the rotation direction of the plate cylinder 16, and the metering roller 40 and ductor roller 41 are driven to rotate in the same direction (the clockwise direction in FIG. 5) as the rotation direction of the plate cylinder 16.

Figure 5:
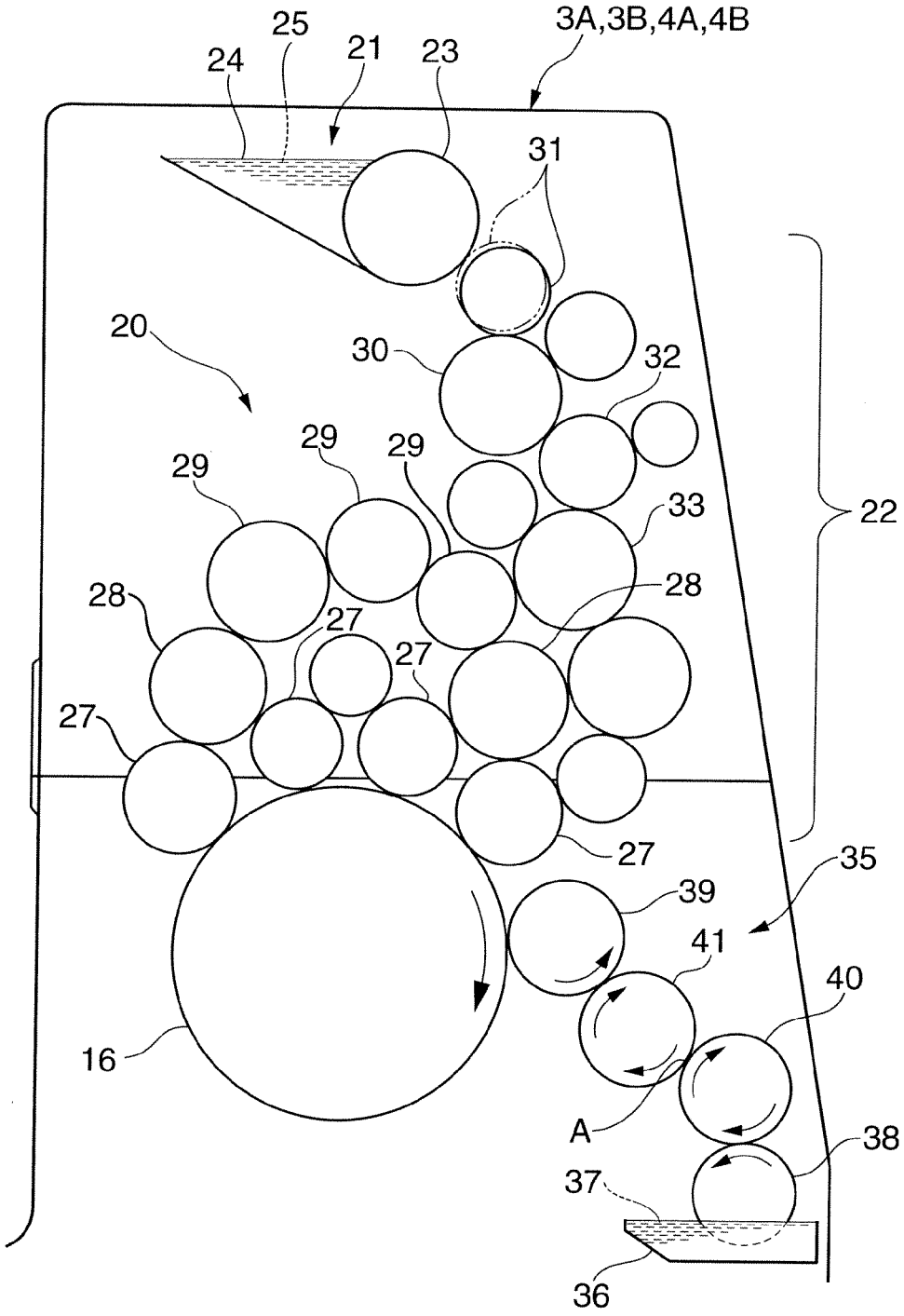
FIG. 5 is a view for explaining details of a cylinder array shown in FIG. 1.

The metering roller 40 and ductor roller 41 are driven to rotate in the same rotation direction (the clockwise direction in FIG. 5) so as to produce a counter-slip between them, i.e., so that their contact surfaces rotate in opposite directions at a contract point A (FIG. 5). In this arrangement, the dampening water 37 raised from the water pan 36 to the water fountain roller 38 is transferred onto the metering roller 40 at the contact point between the water fountain roller 38 and the metering roller 40.

By driving the metering roller 40 and ductor roller 41 to rotate so as to produce a counter-slip between them, a given minimum necessary amount of dampening water 37 is transferred from the metering roller 40 onto the metering roller 40 at the contract point A. Because the dampening water 37 is supplied in an amount optimum for the ink to the plate surface of the printing plate mounted on the peripheral surface of the plate cylinder 16, it is possible to prevent excessive emulsification of the highly reactive ink 25 supplied from the ink form rollers 27 onto the plate surface of the printing plate mounted on the plate cylinder 16.

Figure 2:
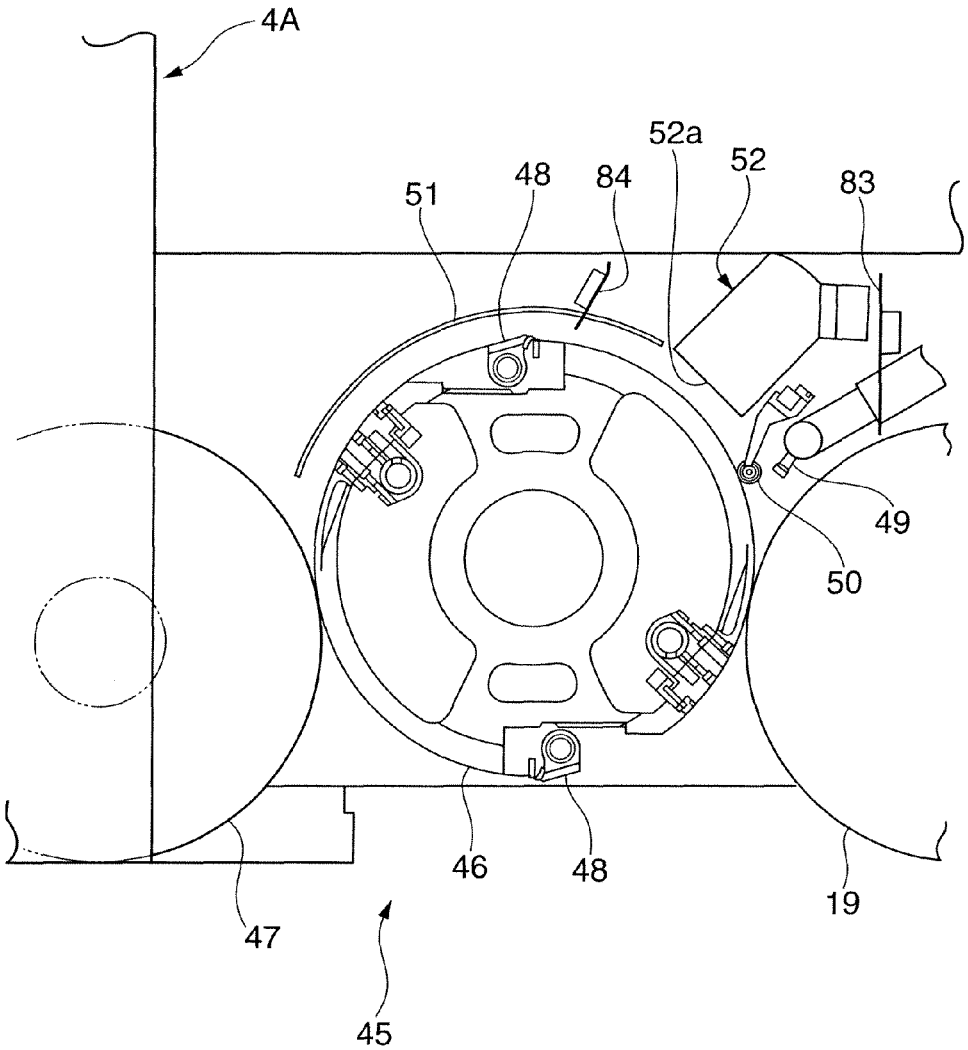
FIG. 2 is an enlarged view of a portion II in FIG. 1.

As shown in FIG. 2, the known convertible press 45 includes the suction cylinder 46 which has a pair of grippers 48 and is in contact with the transfer cylinder 19 of the printing unit 3B, and a convertible cylinder 47 which is provided between the suction cylinder 46 and the impression cylinder 18 (FIG. 1) of the printing unit 4A and is in contact with the two cylinders 46 and 18. The convertible press 45 changes the phase of the rotation direction of the convertible cylinder 47 with respect to the suction cylinder 46 to selectively transfer the forward edge (leading edge) of the paper sheet 10 held by the suction cylinder 46 to a gripper device (not shown) of the convertible cylinder 47 or transfer the rear edge (trailing edge) of the paper sheet 10 to the gripper device. Hence, it is selected whether the paper sheet 10 gripped by the grippers 48 of the suction cylinder 46 is to be transferred to the convertible cylinder 47 while or without being reversed.

An air blowing nozzle 49 is in close proximity to the suction cylinder 46, and blows air onto the peripheral surface of the suction cylinder 46 to restrict fluttering of the paper sheet 10 transferred from the transfer cylinder 19 onto the suction cylinder 46. A roller guide 50 is in press contact with the peripheral surface of the suction cylinder 46 to bring the paper sheet 10 transported by the suction cylinder 46 into tight contact with the peripheral surface of the suction cylinder 46. A sheet guide 51 has an arcuated cross-section with the same curvature as the peripheral surface of the suction cylinder 46, and is placed with a predetermined spacing from the peripheral surface of the suction cylinder 46.

Figure 4:
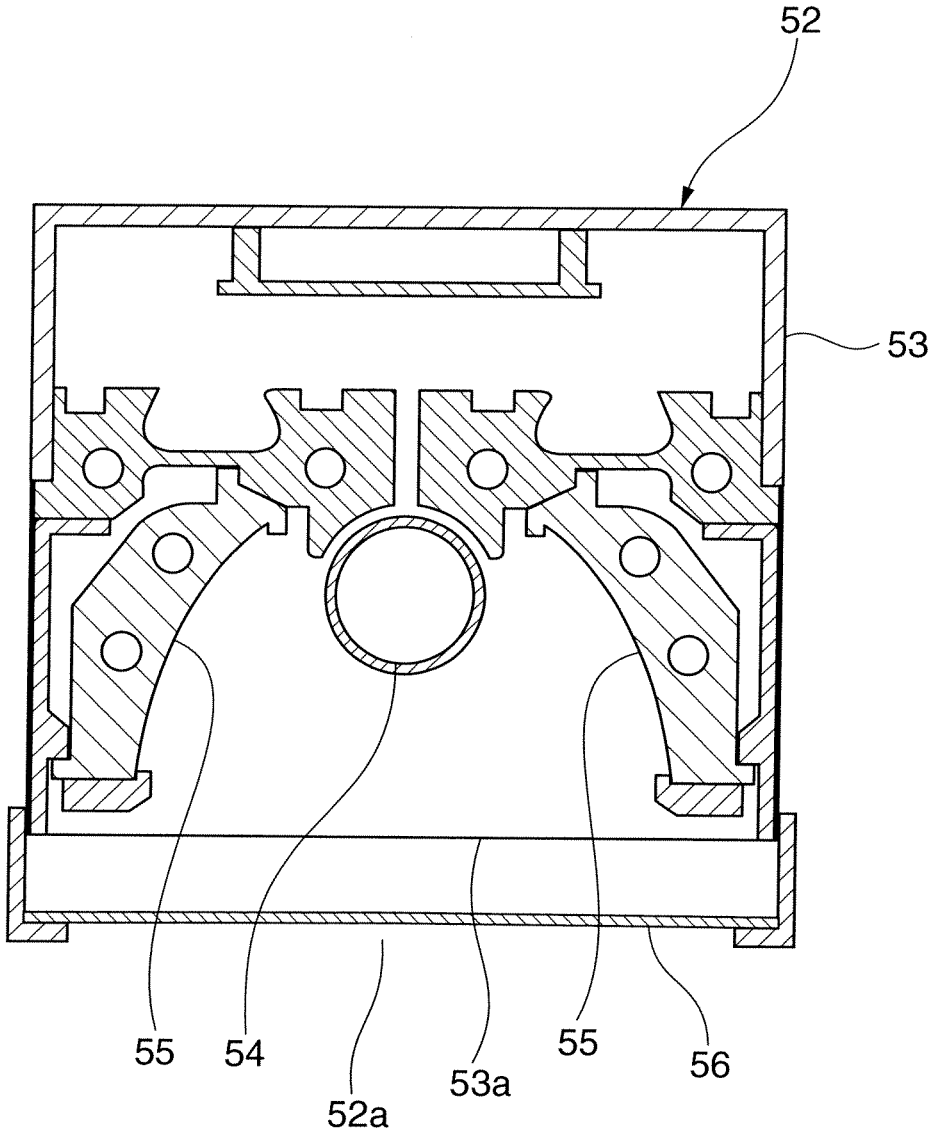
FIG. 4 is a sectional view of a light irradiation device shown in FIG. 2.

The light irradiation device 52 is provided in the convertible press 45 such that its irradiation surface 52*a* is opposed to the outer peripheral surface of the suction cylinder 46. The light irradiation device 52 irradiates the paper sheet 10 transported by the suction cylinder 46 with light having ultraviolet wavelengths to cure the highly reactive ink 25 printed on the paper sheet 10 by the printing units 3A and 3B. As shown in FIG. 4, the light irradiation device 52 includes a box-shaped housing 53 having an irradiation opening 53*a* formed in the irradiation surface 52*a*, and an ozoneless type UV lamp (to be referred to as an ozoneless UV lamp hereinafter) 54 is fixed at the central portion of the housing 53.

The ozoneless UV lamp 54 emits light having ultraviolet wavelengths other than light wavelengths in the ozone generation range. Because the light from the ozoneless UV lamp 54 contains no light wavelength in the ozone generation range, the ozoneless UV lamp 54 generates no ozone even if it irradiates oxygen. A semispherical reflecting mirror 55 surrounds the ozoneless UV lamp 54, so light emitted by the ozoneless UV lamp 54 is reflected by the reflecting mirror 55 and guided to the outside from the irradiation surface 52*a* via the irradiation opening 53*a*.

Figure 6:
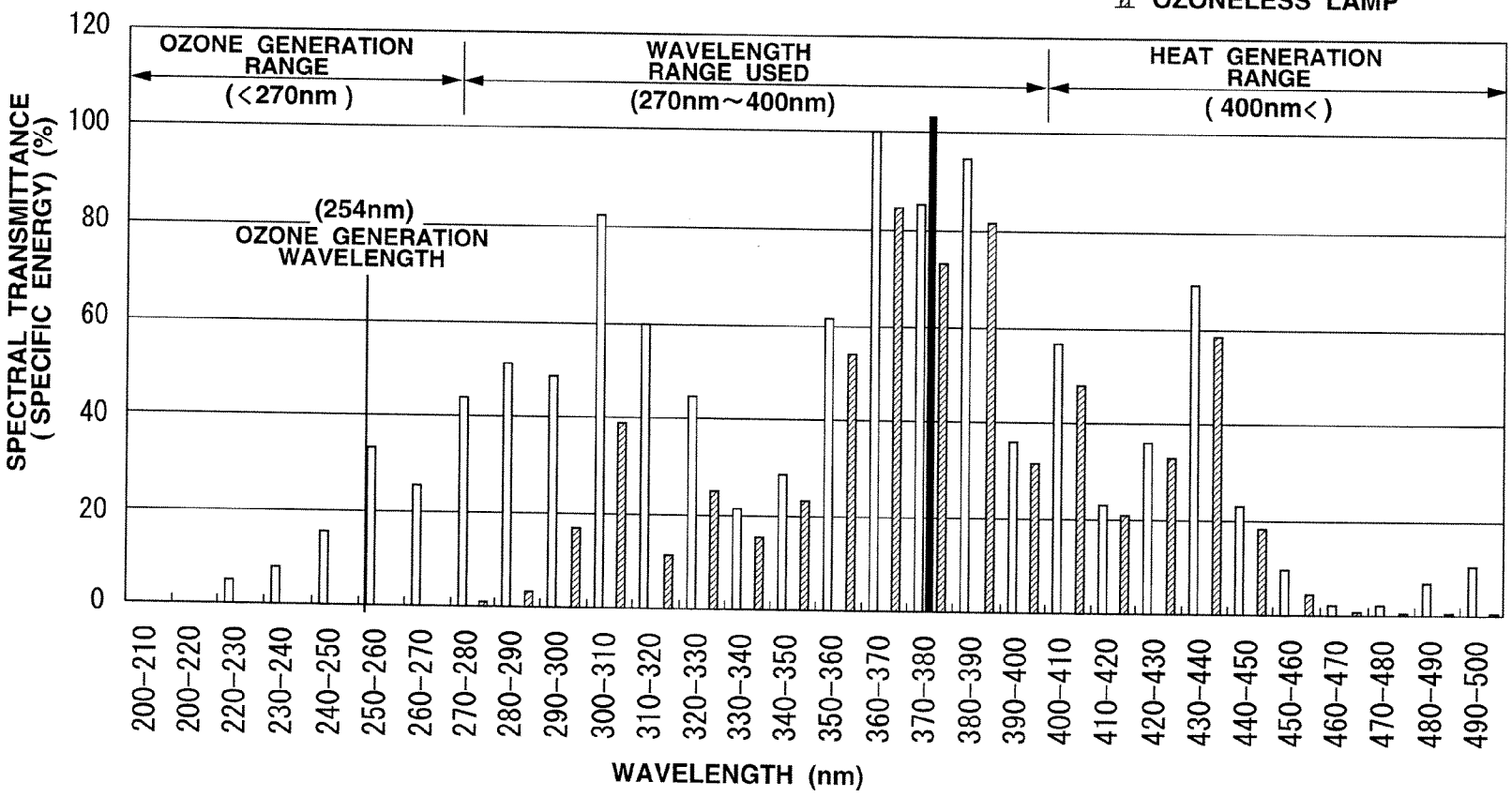
FIG. 6 is a graph showing the wavelength distribution of light emitted by an ozoneless lamp shown in FIG. 4.

The ozoneless UV lamp 54 employs silica glass containing a small amount of impurity in an arc tube of a UV lamp serving as a discharge lamp. Silica glass containing an impurity absorbs light having wavelengths in the ozone generation range to prevent ozone generation. Hence, light emitted by the ozoneless UV lamp 54 contains no wavelength in the ozone generation range (wavelengths less than 270 nm) which includes an ozone generation wavelength of 254 nm, as shown in FIG. 6.

In contrast, light emitted by a metal halide lamp contains wavelengths in the ozone generation range. Also, an LED emits light containing no wavelength in the ozone generation range, and emits only light in the narrow wavelength range of 370 nm to 380 nm.

As shown in FIG. 4, the light irradiation device 52 includes a cut filter (optical filter) 56 in the irradiation opening 53*a*. The cut filter 56 absorbs (cuts off) light wavelengths in the heat generation range, i.e., wavelengths more than 400 nm shown in FIG. 6 in light emitted by the ozoneless UV lamp 54. Therefore, the light irradiation device 52 emits light in the wavelength range of 270 nm to 400 nm upon filtering out wavelengths in both the ozone generation range and heat generation range via the irradiation surface 52*a*.

In this embodiment, a discharge lamp which emits light by discharge in a gas such as neon or xenon, the vapor of a metal such as mercury, sodium, or scandium, or a gas mixture thereof is employed as the ozoneless UV lamp 54. A light source of the light irradiation device 52 includes no LED. The light irradiation device 52 is defined as an ozoneless lamp which includes a discharge lamp and emits light having ultraviolet wavelengths including no ozone generation wavelength emitted by the discharge lamp.

Although an example in which the ozoneless UV lamp 54 which emits light containing no wavelength in the ozone generation range has been explained in this embodiment, a general discharge lamp which emits light containing an ozone generation wavelength may be employed in place of the ozoneless UV lamp 54. In this case, in addition to the cut filter 56 which absorbs wavelengths in the heat generation range, another cut filter which absorbs wavelengths in the ozone generation range need only be provided in the irradiation opening 53*a*. An ozoneless type UV lamp can be employed even when a cut filter which absorbs wavelengths in the ozone generation range is provided, as a matter of course. When there is no need to absorb wavelengths in the heat generation range, light from the ozoneless UV lamp 54 can be directly guided to the outside from the irradiation surface 52*a* without requiring the cut filter 56.

Also, although the wavelength range of light emitted by the light irradiation device 52 is set to 270 nm to 400 nm, this does not limit the present invention to the condition in which the wavelength of light from the light irradiation device 52 contains all wavelength components in this wavelength range. That is, wavelengths in an arbitrary range may be set as long as this range approximately falls within the wavelength range of 270 nm to 400 nm, so it is only necessary to set the lower limit of the wavelength to 260 nm to 300 nm and its upper limit to 380 nm to 420 nm. According to the present invention, by setting the wavelength of light from the light irradiation device 52 to fall within the wide range of 270 nm to 400 nm, the highly reactive ink 25 can be selected from various types of inks which react to light with a specific wavelength among a wide range of wavelengths, thus widening the range of options for ink.

As shown in FIG. 2, light-shielding plates 83 and 84 are provided in the vicinity of the light irradiation device 52. The light-shielding plates 83 and 84 prevent light which is emitted by the ozoneless UV lamp 54 and reflected by the paper sheet 10 and the peripheral surface of the suction cylinder 46 from leaking out of the sheet-fed offset rotary printing press 1.

Figure 3:
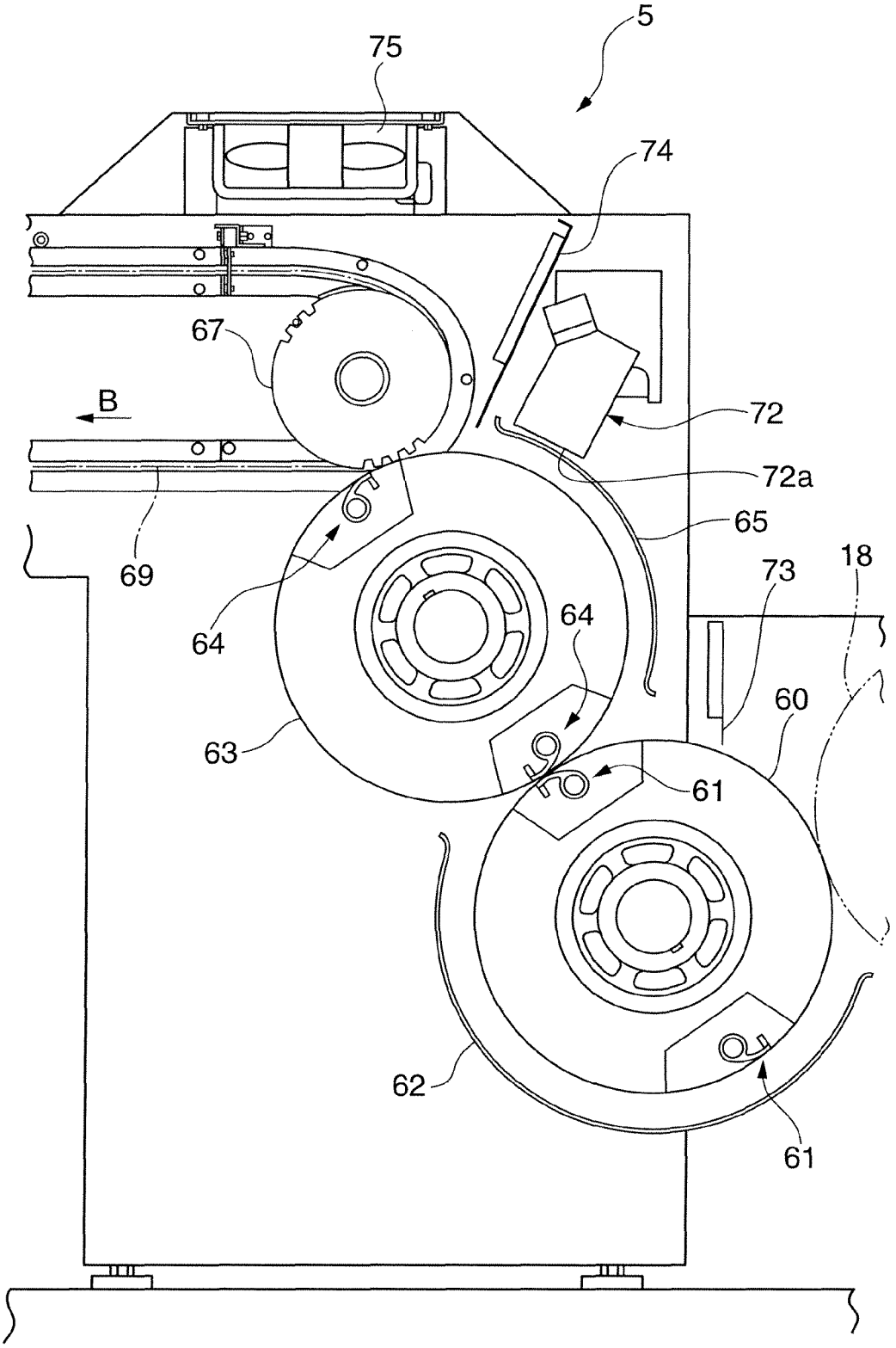
FIG. 3 is an enlarged view of a portion III in FIG. 1.

The sheet delivery device 5 will be described next with reference to FIGS. 1 and 3. As shown in FIG. 3, a pair of grippers 61 which transfer, by a gripping change, the paper sheet 10 transported by the impression cylinder 18 are provided on a transfer cylinder 60 in contact with the impression cylinder 18 of the printing unit 4B. A pair of grippers 64 which transfer, by a gripping change, the paper sheet 10 from the pair of grippers 61 of the transfer cylinder 60 are provided on a transfer cylinder 63 in contact with the transfer cylinder 60. Sheet guides 62 and 65 with arcuated cross-sections are attached to the transfer cylinders 60 and 63, respectively, so as to cover their outer peripheral surfaces.

As shown in FIG. 1, a pair of sprockets 67 and 68 are provided in the front and rear portions, respectively, of the sheet delivery device 5, and a pair of endless delivery chains 69 are suspended across the sprockets 67 and 68. Gripper bars (not shown) which grip the paper sheet 10 transferred by a gripping change from the grippers 64 of the transfer cylinder 63 are disposed on the delivery chains 69 with predetermined spacings between them. The paper sheet 10 gripped by the gripper bars is transported by the delivery chains 69 traveling in the sheet delivery direction (a direction indicated by an arrow B). The paper sheet 10 transported by the delivery chains 69 is freed from the gripping of the gripper bars by a cam device (not shown) for use in gripper removal, and falls and stacks on a pile board 70. The light irradiation device 72 is provided in the sheet delivery device 5 such that its irradiation surface 72*a* is opposed to the outer peripheral surface of the transfer cylinder 63.

The light irradiation device 72 with the same structure as the light irradiation device 52 cures the highly reactive ink 25 on the paper sheet 10 which is printed by the printing units 4A and 4B and gripped and transported by the grippers 64 of the transfer cylinder 63. As shown in FIG. 3, light-shielding plates 73 and 74 are provided in the vicinity of the light irradiation device 72. The light-shielding plates 73 and 74 prevent light which is emitted by the light irradiation device 72 and reflected by the paper sheet 10 and the peripheral surface of the transfer cylinder 63 from leaking out of the sheet-fed offset rotary printing press 1. A fan 75 is placed in the upper portion of the sheet delivery device 5. The fan 75 exhausts, e.g., heat generated inside the sheet delivery device 5 to the outside of the sheet-fed offset rotary printing press 1.

A printing operation and ink curing operation in the sheet-fed offset rotary printing press 1 with the foregoing arrangement will be described next.

First, as shown in FIG. 2, the phase of the rotation direction of the convertible cylinder 47 with respect to the suction cylinder 46 of the convertible press 45 is adjusted so that the gripper device (not shown) of the convertible cylinder 47 is opposed to the rear edge (trailing edge) of the paper sheet 10 held by the suction cylinder 46. That is, that phase is switched in advance so that the paper sheet 10 transferred from the suction cylinder 46 onto the convertible cylinder 47 is reversed by the convertible cylinder 47.

In this state, the paper sheets 10 fed from the sheet feeding device 2 shown in FIG. 1 to the feedboard 12 one by one by the suction device (not shown) is transported upon being transferred by a gripping change from the swing arm shaft pregripper 13 to grippers of the impression cylinder 18 of the printing unit 3A. The paper sheet 10 transported by the impression cylinder 18 has its obverse surface printed in the first color while passing through the gap between the impression cylinder 18 and blanket cylinder 17 of the printing unit 3A, and is transported upon being transferred by a gripping change to grippers of the impression cylinder 18 of the printing unit 3B via the transfer cylinder 19. The paper sheet 10 transported by the impression cylinder 18 has its obverse surface printed in the second color while passing through the gap between the impression cylinder 18 and blanket cylinder 17 of the printing unit 3B.

The paper sheet 10 printed in the second color is transported upon being transferred by a gripping change to the grippers 48 of the suction cylinder 46 via the transfer cylinder 19 of the convertible press 45, and the highly reactive ink 25 printed on the obverse surface of the paper sheet 10 cures with light emitted by the light irradiation device 52. At this time, because the light from the light irradiation device 52 contains no wavelength which generates ozone, no device for processing ozone is necessary.

Also, because a low-power ozoneless lamp with a low light irradiation energy is employed, neither a cooling duct nor a peripheral equipment is necessary, thereby making it possible to attain both space saving and energy saving. Moreover, because highly reactive ink which rapidly cures with a low light irradiation energy is employed, no anti-setoff powder is necessary, thereby obviating the need for a device for spraying powder and that for processing the sprayed powder.

By driving the metering roller 40 and ductor roller 41 which constitute the dampening device 35 to rotate so as to produce a counter-slip between them, a given minimum necessary amount of dampening water 37 is transferred onto the ductor roller 41 at the contract point A. Hence, an optimum amount of dampening water 37 is supplied onto the plate surface of the printing plate mounted on the plate cylinder 16, thereby preventing excessive emulsification of the highly reactive ink 25 supplied from the ink form rollers 27 of the inking device 20 onto that plate surface. This makes it possible to keep the highly reactive ink 25 in an optimum emulsified state, thereby reliably curing the highly reactive ink 25 despite its irradiation by the ozoneless UV lamp 54 with a low light irradiation energy.

By filtering out wavelengths in the heat generation range from light emitted by the ozoneless UV lamp 54, the amount of heat acting on the paper sheet 10 is reduced, so thermal deformation of the paper sheet 10 is prevented. This makes it possible to improve the quality of a printing product.

The paper sheet 10 on which the highly reactive ink 25 printed on its obverse surface has cured by means of the ozoneless UV lamp 54 is reversed by the convertible cylinder 47, and transported upon being transferred by a gripping change to grippers of the impression cylinder 18 of the printing unit 4A. The paper sheet 10 transported by the impression cylinder 18 has its reverse surface printed in the first color while passing through the gap between the impression cylinder 18 and the blanket cylinder 17, and is transported upon being transferred by a gripping change to grippers of the impression cylinder 18 of the printing unit 4B via the transfer cylinder 19. The paper sheet 10 transported by the impression cylinder 18 has its reverse surface printed in the second color while passing through the gap between the impression cylinder 18 and the blanket cylinder 17.

The paper sheet 10 having its reverse surface printed in the second color is transported upon being transferred by a gripping change to the grippers 61 of the transfer cylinder 60. When the paper sheet 10 is transported upon being transferred by a gripping change from the grippers 61 of the transfer cylinder 60 to the grippers 64 of the transfer cylinder 63, the highly reactive ink 25 on its reverse surface cures with light emitted by the light irradiation device 72. The paper sheet 10 on which the highly reactive ink 25 printed on its reverse surface has cured is transported in the direction indicated by the arrow B upon being transferred by a gripping change from the grippers 64 of the transfer cylinder 63 to delivery grippers of the delivery chains 69, and falls and stacks on the pile board 70 of the sheet delivery device 5.

In the first embodiment described above, after the paper sheet 10 is reversed by the convertible press 45, the reverse surface of the paper sheet 10 is printed by the printing units 4A and 4B. However, the present invention is not limited to this, and the obverse surface of the paper sheet 10 may be printed by the printing units 4A and 4B without reversing the paper sheet 10 by the convertible press 45. In this case, the highly reactive ink 25 on the obverse surface of the paper sheet 10 cures with light emitted by the light irradiation device 72 provided in the sheet delivery device 5.

[Second Embodiment]

Figure 7:
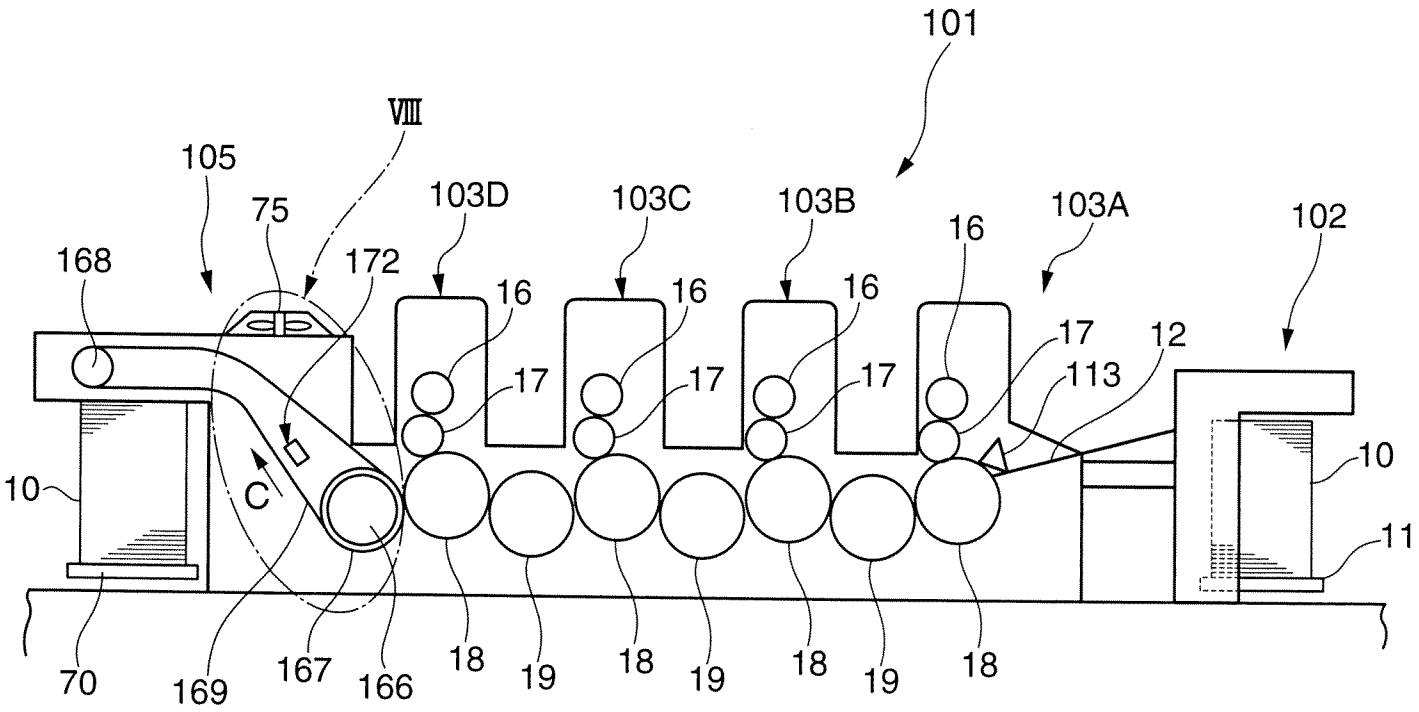
FIG. 7 is a side view showing the schematic arrangement of a sheet-fed offset rotary printing press according to the second embodiment of the present invention.
Figure 8:
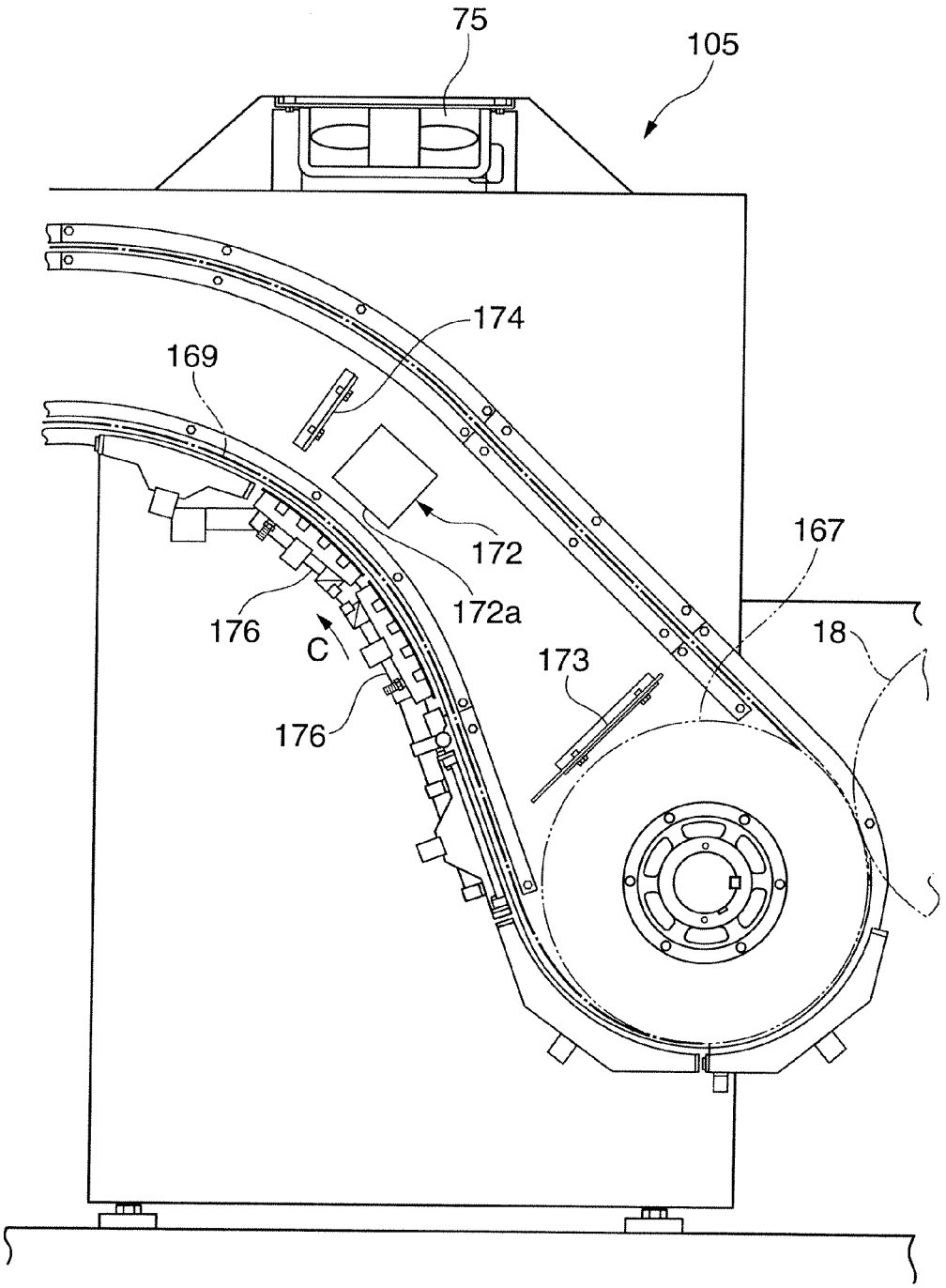
FIG. 8 is an enlarged view of a portion VIII in FIG. 7.

The second embodiment according to the present invention will be described next with reference to FIGS. 7 and 8. The same reference numerals as in the first embodiment denote the same or equivalent members in the second embodiment, and a detailed description thereof will not be given according to circumstances involved. A sheet-fed offset rotary printing press 101 according to the second embodiment is different from the sheet-fed offset rotary printing press 1 according to the first embodiment in that the former includes no convertible press 45 and prints on only one surface of a paper sheet 10.

The sheet-fed offset rotary printing press 101 includes a sheet feeding device 102 which supplies paper sheets 10 to a feedboard 12 one by one, four printing units 103A to 103D which print on the surface of the paper sheet 10 supplied from the sheet feeding device 102, and a sheet delivery device 105 which delivers the paper sheet 10 printed by the printing units 103A to 103D. A swing arm shaft pregripper 113 is provided between the sheet feeding device 102 and the printing unit 103A. The swing arm shaft pregripper 113 grips the front edge of the paper sheet 10 fed from the sheet feeding device 102 to the feedboard 12, and transfers it to grippers of an impression cylinder 18 of the printing unit 103A by a gripping change.

A plate cylinder 16 provided in each of the printing units 103A to 103D includes the same inking device and dampening device (neither is shown) as in the first embodiment. The sheet delivery device 105 includes a delivery cylinder 166 in contact with the impression cylinder 18 of the printing unit 103D. A pair of endless delivery chains 169 are suspended across a sprocket 167 fixed in position coaxially with the delivery cylinder 166 and a sprocket 168 provided in the rear portion of the sheet delivery device 105.

Gripper bars (not shown) which grip the paper sheet 10 transferred by a gripping change from grippers of a transfer cylinder 63 are disposed on the delivery chains 169 with predetermined spacings between them. The paper sheet 10 gripped by the gripper bars is transported by the delivery chains 169 traveling in a direction indicated by an arrow C. The paper sheet 10 transported in the direction indicated by the arrow C by the delivery chains 169 is freed from the gripping of the gripper bars by a cam device (not shown) for use in gripper removal, and falls and stacks on a pile board 70. A light irradiation device 172 is provided in the sheet delivery device 105 between the delivery chains 169 such that its irradiation surface 172*a* is opposed to the lower delivery chain 169 which transports the paper sheet 10 in the direction indicated by the arrow C. An air guide 176 equipped with a cooling device is placed along the lower delivery chain 169 at the position at which it is opposed to the light irradiation device 172 through the lower delivery chain 169.

The light irradiation device 172 with the same structure as the light irradiation devices 52 and 72 in the first embodiment cures highly reactive ink 25 on the paper sheet 10 which is printed by the printing units 103A to 103D and transported upon being transferred by a gripping change to delivery grippers of the delivery chains 169. Light-shielding plates 173 and 174 are placed in the vicinity of the light irradiation device 172. The light-shielding plates 173 and 174 prevent light which is emitted by the light irradiation device 172 and reflected by the paper sheet 10 and air guide 176 from leaking out of the sheet-fed offset rotary printing press 101.

A printing operation and ink curing operation in the sheet-fed offset rotary printing press 101 with the foregoing arrangement will be described next. The paper sheets 10 fed from a sheet feeding device 2 shown in FIG. 7 to the feedboard 12 one by one by a suction device (not shown) is transported upon being transferred by a gripping change from the swing arm shaft pregripper 113 to the grippers of the impression cylinder 18 of the printing unit 103A.

The paper sheet 10 transported by the impression cylinder 18 has its surface printed in the first color while passing through the gap between the impression cylinder 18 and a blanket cylinder 17, and is transported upon being transferred by a gripping change to grippers of the impression cylinder 18 of the printing unit 103B via a transfer cylinder 19. The paper sheet 10 transported by the impression cylinder 18 has its surface printed in the second color while passing through the gap between the impression cylinder 18 and the blanket cylinder 17. After that, the paper sheet 10 which has its surface sequentially printed in the third and fourth colors by the printing units 103C and 103D, respectively, is transported in the direction indicated by the arrow C upon being transferred by a griping change from the impression cylinder 18 of the printing unit 103D to the delivery grippers of the delivery chains 169.

The highly reactive ink 25 printed on the surface of the paper sheet 10 transported by the delivery chains 169 cures with light emitted by the light irradiation device 172 in the process of transportation. The paper sheet 10 transported in the direction indicated by the arrow C by the delivery chains 169 falls and stacks on the pile board 70 of the sheet delivery device 5. In this manner, actions and effects similar to those in the first embodiment can be obtained by the light irradiation device 172 in the second embodiment as well.

Although the highly reactive ink 25 is printed on the paper sheet 10 in this embodiment, the present invention is not limited to this example. The present invention may also be applied when, for example, the surface of the paper sheet 10 is coated with highly reactive varnish (highly reactive transfer liquid) which cures with a low light irradiation energy emitted by an ozoneless UV lamp 54. Also, although a dampening device 35 includes four rollers 38 to 41, it may include five or more rollers as needed. Moreover, although the transfer object is the paper sheet 10, it may be a web or a film-like sheet in place of a paper sheet.

Although an example in which ozoneless lamps are employed as the light irradiation devices 52, 72, and 172 has been explained in this embodiment, a combination of a plurality of LEDs with different wavelengths may be employed as each light irradiation device. In this case, actions and effects equivalent to those obtained by the above-mentioned ozoneless lamp which emits light in a wide wavelength range can be obtained.

As described above, according to the present invention, ink (highly reactive ink) on a transfer object can sufficiently cure despite the use of a low-light-output ozoneless lamp. This attains ozoneless, energy-saving, powder-less (anti-setoff powder spraying is unnecessary) printing/coating, thus making it possible to provide an environment-friendly printing/coating method and apparatus. Also, no device for processing ozone is necessary because no ozone is generated, thus making it possible to reduce the cost. Moreover, neither a cooling duct nor a peripheral equipment is necessary because of the use of a low-light-output ozoneless lamp, thus attaining space saving.

From the standpoint of an ink manufacturer, there is no need to develop ink assuming the use of light with limited wavelengths, such as LED-UV. Hence, the ink manufacturer can develop ink which rapidly cures with an arbitrary wavelength among a wide range of wavelengths output from an ozoneless lamp. This means that the ink manufacturer can develop ink with good printing quality that is the original goal of ink.

From the standpoint of the user, not only ink/varnish for LED-UV but also highly reactive ink or varnish can be used. Hence, the user is offered a wider range of options for ink and can use ink optimum for a printing product.

By filtering out wavelengths in the heat generation range from light emitted by an ozoneless lamp, the amount of heat acting on a transfer object is reduced, so thermal deformation of the transfer object is prevented. This makes it possible to improve the quality of a printing product. Because highly reactive ink/varnish can be selected from various types of inks/varnishes which react to an arbitrary wavelength among a wide range of wavelengths, the range of options for ink widens.

What is claimed is:

1. A printing/coating method comprising the steps of:

arranging a light irradiation device that does not include a light-emitting diode in vicinity of a transport path where a transfer object is conveyed;

transferring a highly reactive ink/varnish which cures with a light energy onto the transfer object;

irradiating the transfer object which is conveyed on the transport path after being transferred with light in a particular wavelength range of 260 nm to 420 nm where a lower limit is 260 nm to 300 nm which does not include an ozone generation range and an upper limit is 380 nm to 420 nm which does not include a heat generation range, the irradiating comprising irradiating the transfer object with light containing all wavelength components in a wavelength range of 270 nm to 400 nm using an ozoneless lamp as said light irradiation device;

curing the highly reactive ink/varnish that is transferred onto the transfer object with the irradiated light in the particular wavelength range, in which no ozone is generated, to cure the highly reactive ink/varnish on the transfer object, wherein the irradiating further comprises filtering out light in a wavelength range which includes at least light in a heat generation range and has wavelength greater than or equal to 400 nm from light in the particular wavelength range generated by said ozoneless lamp before irradiating the transfer object.

2. A method according to claim 1, further comprising preventing light irradiated from said light irradiation device and reflected on the transfer object from leaking out.

3. A printing/coating apparatus comprising:

a transfer liquid supply device which supplies ink/varnish onto a plate cylinder;

a dampening device which has a pair of rollers which are in contact with each other and are driven to rotate so as to produce a counter-slip therebetween, and supplies dampening water onto the plate cylinder via the pair of rollers;

a transfer device which uses the ink/varnish supplied from the transfer liquid supply device and the dampening water supplied from said dampening device to transfer the ink/varnish onto a transfer object;

a transport device which transports the transfer object from said transfer device;

a light irradiation device which irradiates the transfer object being transported by said transport device with light in a wavelength range that has a lower limit of 260 nm to 300 nm which does not include an ozone generation range and an upper limit of 380 nm to 420 nm which does not include a heat generation range to cure the ink/varnish transferred on the transfer object, said light irradiation device not including a light-emitting diode, wherein said light irradiation device comprises an ozoneless lamp which generates light containing all wavelength components in a wavelength range of 270 nm to 400 nm, and irradiates the transfer object with the light, and an optical filter which filters out light in a wavelength range which includes at least the heat generation range and has wavelength greater than or equal to 400 nm from the light generated by said ozoneless lamp.

4. An apparatus according to claim 3, further comprising a light-shielding plate which prevents light irradiated from said light irradiation device and reflected on the transfer object from leaking out.

5. A printing/coating apparatus comprising:

a transfer liquid supply device which supplies ink/varnish onto a plate cylinder;

a dampening device which has a pair of rollers which are in contact with each other and are driven to rotate so as to produce a counter-slip therebetween, and supplies dampening water onto the plate cylinder via the pair of rollers;

a transfer device which uses the ink/varnish supplied from the transfer liquid supply device and the dampening water supplied from said dampening device to transfer the ink/varnish onto a transfer object;

a transport device which transports the transfer object from said transfer device;

a light irradiation device which irradiates the transfer object being transported by said transport device with light to cure the ink/varnish transferred on the transfer object, said light irradiation device not including a light-emitting diode, wherein said light irradiation device comprises:

a discharge lamp which generates light including ultraviolet wavelength and containing all wavelength components in a wavelength range of 270 nm to 400 nm;

a first light filter which filters out light in a wavelength range which includes at least an ozone generation range and has wavelength less than or equal to 270 nm generated by said discharge lamp; and a second light filter which filters out light in a wavelength range which includes at least a heat generation range and has wavelength greater than or equal to 400 nm from light outputted from said first light filter.

6. An apparatus according to claim 5, further comprising a light-shielding plate which prevents light irradiated from said light irradiation device and reflected on the transfer object from leaking out.

7. A printing/coating method comprising the steps of:

arranging a light irradiation device that does not include a light-emitting diode in vicinity of a transport path where a transfer object is conveyed;

transferring a highly reactive ink/varnish which cures with a light energy onto the transfer object;

irradiating the transfer object which is conveyed on the transport path after being transferred with light in a particular wavelength range of 260 nm to 420 nm where a lower limit is 260 nm to 300 nm which does not include an ozone generation range and an upper limit is 380 nm to 420 nm which does not include a heat generation range, the irradiating comprising irradiating the transfer object with light containing all wavelength components in a wavelength range of 270 nm to 400 nm using an ozoneless lamp as said light irradiation device;

curing the highly reactive ink/varnish that is transferred onto the transfer object with the irradiated light in the particular wavelength range, in which no ozone is generated, to cure the highly reactive ink/varnish on the transfer object.

8. A printing/coating apparatus comprising:

a transfer liquid supply device which supplies ink/varnish onto a plate cylinder;

a dampening device which has a pair of rollers which are in contact with each other and are driven to rotate so as to produce a counter-slip therebetween, and supplies dampening water onto the plate cylinder via the pair of rollers;

a transfer device which uses the ink/varnish supplied from the transfer liquid supply device and the dampening water supplied from said dampening device to transfer the ink/varnish onto a transfer object;

a transport device which transports the transfer object from said transfer device;

a light irradiation device which irradiates the transfer object being transported by said transport device with light in a wavelength range that has a lower limit of 260 nm to 300 nm which does not include an ozone generation range and an upper limit of 380 nm to 420 nm which does not include a heat generation range to cure the ink/varnish transferred on the transfer object, said light irradiation device not including a light-emitting diode, wherein said light irradiation device comprises an ozoneless lamp which generates light containing all wavelength components in a wavelength range of 270 nm to 400 nm, and irradiates the transfer object with the light.

* * * * *